US009789689B2

(12) United States Patent
Ogata et al.

(10) Patent No.: US 9,789,689 B2
(45) Date of Patent: Oct. 17, 2017

(54) METHOD OF FORMING THROUGH-SUBSTRATE

(71) Applicant: CANON KABUSHIKI KAISHA, Tokyo (JP)

(72) Inventors: Yoshinao Ogata, Fukushima (JP); Seiko Minami, Warabi (JP); Masataka Kato, Hiratsuka (JP); Masaya Uyama, Kawasaki (JP); Toshiyasu Sakai, Kawasaki (JP); Hiroshi Higuchi, Atsugi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/728,065

(22) Filed: Jun. 2, 2015

(65) Prior Publication Data

US 2015/0360470 A1 Dec. 17, 2015

(30) Foreign Application Priority Data

Jun. 16, 2014 (JP) ..... 2014-123349

(51) Int. Cl.
*B41J 2/16* (2006.01)

(52) U.S. Cl.
CPC ..... *B41J 2/1628* (2013.01); *B41J 2/1603* (2013.01); *B41J 2/1631* (2013.01); *B41J 2/1645* (2013.01)

(58) Field of Classification Search
CPC . H01L 2224/75155; H01L 2224/76155; H01L 2224/77155; H01L 2224/79155; H01L 2224/82102; B41J 2/1626; B41J 2/1631; B41J 2/1628
See application file for complete search history.

(56) References Cited

U.S. PATENT DOCUMENTS 5,637,189 A * 6/1997 Peeters ..... H01L 21/30621 216/67
7,837,887 B2 11/2010 McReynolds et al.
8,623,674 B2 1/2014 Uyama
9,102,153 B2 8/2015 Sakai et al.
2001/0028378 A1* 10/2001 Lee ..... B41J 2/1433 347/68
2003/0027426 A1* 2/2003 Milligan ..... B41J 2/1404 438/700
2007/0278181 A1* 12/2007 Tsuboi ..... B41J 2/1609 216/58
2009/0242512 A1* 10/2009 Beaudry ..... H01L 21/30655 216/49
2011/0207323 A1* 8/2011 Ditizio ..... B81C 1/00087 438/675
2013/0139388 A1 6/2013 Kato et al.

* cited by examiner

*Primary Examiner* — Michael Jung
*Assistant Examiner* — Mikka Liu
(74) *Attorney, Agent, or Firm* — Fitzpatrick, Cella, Harper & Scinto

(57) ABSTRACT

A method of forming a through-substrate having a first surface and a second surface opposite to the first surface, the method causing the first surface to communicate with the second surface through the substrate, the method including: a first step that forms a first trench from the first surface side of the substrate using dry etching, the first trench having side surfaces on which protective film is formed; and a second step that forms a second trench from the second surface side using dry etching, the second trench communicating with the first trench having the side surfaces on which the protective film is formed.

14 Claims, 9 Drawing Sheets

METHOD OF FORMING THROUGH-SUBSTRATE

BACKGROUND OF THE INVENTION

Field of the Invention

The present invention relates to a method of forming a through-substrate.

Description of the Related Art

As a processing method of forming a through-hole in a substrate, reactive ion etching that is a type of dry etching is widely used. The reactive ion etching introduces reactive gas into a processing chamber to generate plasma, and etches a treatment surface of a substrate using the plasma reactive gas, thereby forming a through-hole having a predetermined shape. More specifically, first, the substrate is fixed on a lower electrode in a processing chamber using an electrostatic chuck. A high-frequency power source is connected across the lower electrode and an upper electrode. The reactive gas is supplied through micropores in the upper electrode. The supplied reactive gas becomes plasma between the upper electrode and the lower electrode. Ions and radicals in the plasma are accelerated in a direction toward the substrate, and collide with the substrate, thereby allowing the substrate to be etched. At this time, if an etching mask is formed on the substrate, an area on the substrate where the etching mask is formed is not etched, and only an area where the substrate is exposed to the surface is etched.

U.S. Pat. No. 7,837,887 discloses a method of forming an ink supply port in an inkjet recording head using reactive ion etching. This method forms a first trench on a first surface of a silicon substrate. The first trench is then filled with photoresist. Subsequently, a second trench communicating with the first trench is formed from a second surface opposite to the first surface toward the first surface. This method removes the filled photoresist using oxygen plasma etching.

SUMMARY OF THE INVENTION

A method of forming a through-substrate according to the present invention is provided, the substrate having a first surface and a second surface opposite to the first surface, the method causing the first surface to communicate with the second surface through the substrate, the method including: a first step that forms a first trench from the first surface side of the substrate using dry etching, the first trench having side surfaces on which protective film is formed; and a second step that forms a second trench from the second surface side using dry etching, the second trench communicating with the first trench having the side surfaces on which the protective film is formed.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

According to the method described in U.S. Pat. No. 7,837,887, as the first trench becomes deeper, it becomes more difficult to fill the first trench with photoresist and remove the photoresist from the first trench.

If the process of filling the first trench with photoresist is omitted, ions and radicals reach the first trench after the second trench communicates with the first trench in the process of forming the second trench. This case causes a problem in that the side surfaces of the first trench are excessively etched to form a through-hole having shape different from a desired shape, thereby sometimes exposing the wiring of elements arranged on the first surface.

The present invention has an object to provide a method of forming a through-substrate that can easily form a through-hole having a desired shape even in the case of forming a deep trench.

Embodiments of the present invention are hereinafter described with reference to the accompanying drawings. In the description and drawings, the same signs are assigned to configuration elements having the same functions, and redundant description is sometimes omitted. The embodiments to be described here do not limit the scope of the present invention. Instead, the embodiments are provided as examples for sufficiently describing the present invention for those skilled in the art.

A substrate manufactured by the forming method of the present invention can be used for various usages. For example, description is hereinafter made assuming that the substrate is for a liquid ejection head.

Figure 1A:
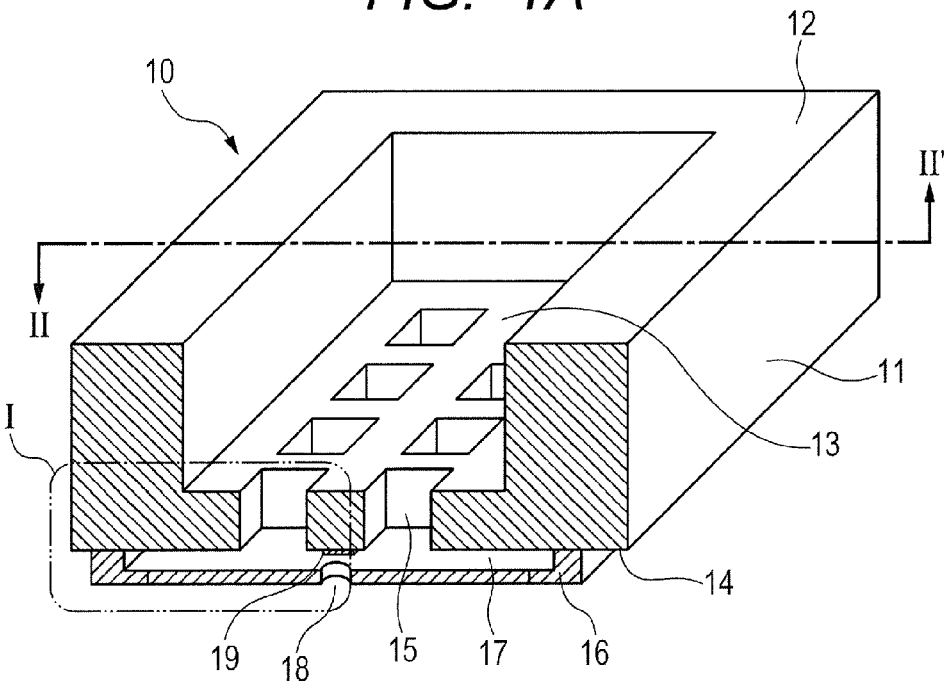
FIGS. 1A, 1B and 1C are diagrams schematically illustrating a part of a configuration of a liquid ejection head 10 according to one embodiment of the present invention.
Figure 1B:
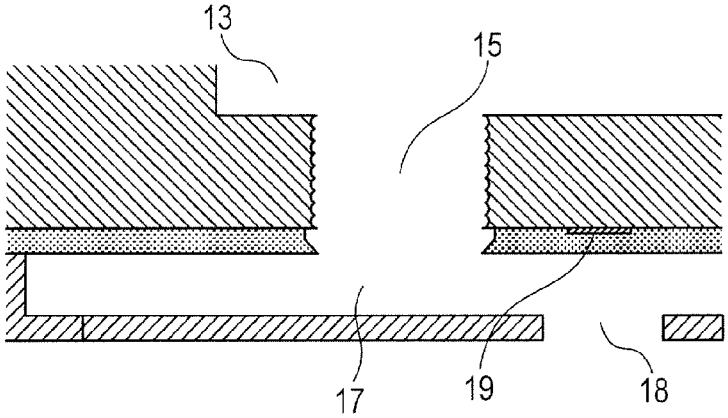
Figure 1C:
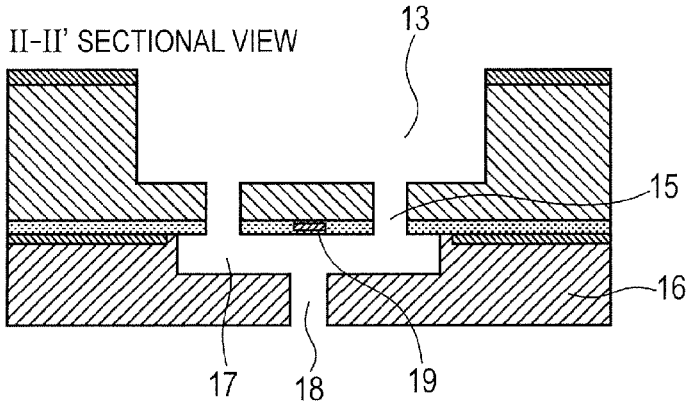

FIGS. 1A and 1B are diagrams schematically illustrating a part of a configuration of a liquid ejection head 10 that includes a substrate 11 manufactured by a method of forming a through-substrate according to one embodiment of the present invention. FIG. 1A is a perspective view schematically illustrating the part of the configuration of the liquid ejection head 10. FIG. 1B is a diagram schematically illustrating a sectional configuration view of a portion I of FIG. 1A. FIG. 1C is a diagram schematically illustrating a configuration taken along line II-II' of FIG. 1A.

The liquid ejection head 10 illustrated in FIG. 1A includes a substrate 11. A first trench 13 is formed on a first surface 12 of the substrate 11. Multiple second trenches 15 that communicate with the first trench 13 are formed on a second surface 14 opposite to the first surface 12. An orifice plate 16 is provided on the second surface 14 so as to form a space between this plate and the second surface 14. This space constitutes a liquid flow path 17. An ejection orifice 18 is formed in the orifice plate 16. An energy generating element 19 is provided on the second surface 14. The energy generating element 19 generates energy used for ejecting liquid, and is, for example, a heater that generates heat energy for film-boiling liquid according to conduction.

FIGS. 1B and 1C illustrate a sectional structure of the liquid ejection head 10. The first trench 13 and the second trenches 15 communicate with the flow path 17. The energy generating element 19 is provided at a position facing the ejection orifice 18 formed on the orifice plate 16.

Figure 2A:
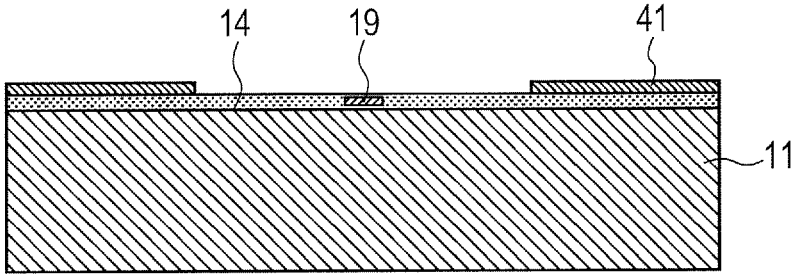
FIGS. 2A, 2B, 2C, 2D, 2E and 2F are diagrams illustrating a process of manufacturing the liquid ejection head 10.

Next, referring to FIGS. 2A to 2F, a process of processing the substrate 11 to manufacture the liquid ejection head 10 is described. First, the substrate 11 is prepared. The substrate 11 is made of, for instance, silicon. FIG. 2A illustrates a state where an energy generating element 19 and a close contact enhancement layer 41 are formed on the second surface 14 of the substrate 11. The close contact enhancement layer 41 is formed in an area except for portions where the second trenches 15 are to be formed in a subsequent process, for example.

Figure 2B:
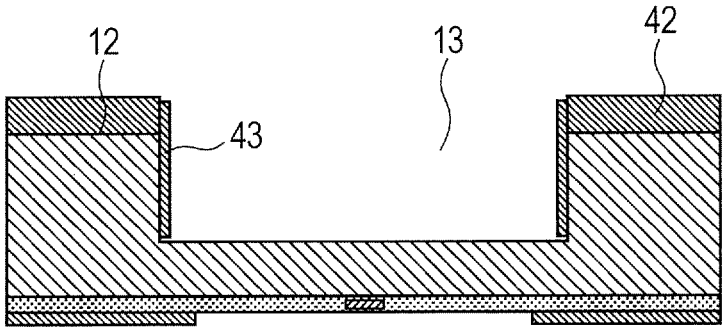

Subsequently, FIG. 2B illustrates a state where an etching mask 42 is formed on the first surface 12 of the substrate 11, portions of the first surface 12 that are not to be etched are covered with the etching mask 42, and then a first trench 13 having side surfaces covered with protective film 43 is formed. The first trench 13 is formed from the first surface side. Here, the first trench 13 is formed by dry etching. The depth is in a range that does not penetrate the substrate 11. For example, an appropriate depth ranges from 50 to 500 μm.

Figure 2C:
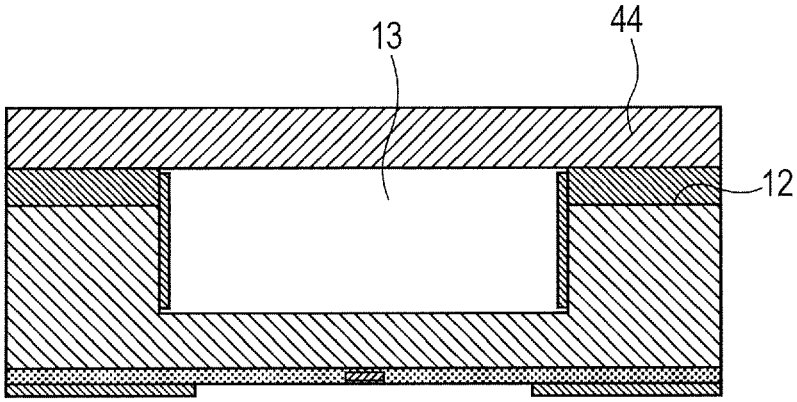

Next, FIG. 2C illustrates a state where an etching stop layer 44 is formed on the first surface 12. The etching stop layer 44 functions as a stop layer that stops etching when the second surface 14 is etched to form the second trenches 15 (not illustrated). The etching stop layer 44 is required to be formed so as to cover the opening of the first trench 13 after the first trench 13 is formed. Thus, formation by spinning application with liquid material is difficult. Consequently, the etching stop layer 44 can be formed using tape used as, for example, dicing tape or backgrind tape, in a semiconductor process. An appropriate material for the etching stop layer 44 can have satisfactory tenting capability for the first trench 13, function as a stop layer for dry etching, and be stripped after etching.

Figure 2D:
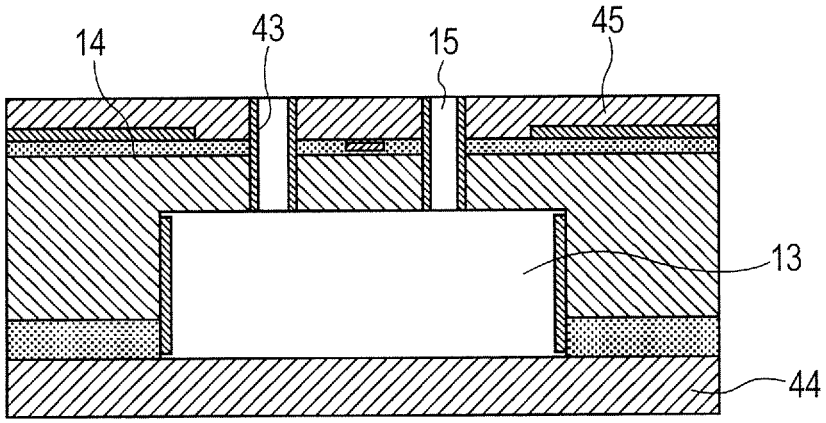

Subsequently, as illustrated in FIG. 2D, the etching mask 45 is formed on the second surface 14, and patterning is performed. Etching is then performed until the second trenches 15 communicate with the first trench 13. The second trenches 15 are formed from the second surface side that is the opposite side of the first surface. Dry etching is adopted to etch the second trench 15. For example, each of isotropic dry etching using radicals and anisotropic dry etching using ions is usable.

Here, the protective film 43 is formed on the side surfaces of the first trench 13. Consequently, even when ions and radicals reach the first trench 13 after the second trenches 15 communicate with the first trench 13, the side surfaces of the first trench 13 are not etched. Thus, the first trench 13 can be maintained in a desired shape.

Figure 2E:
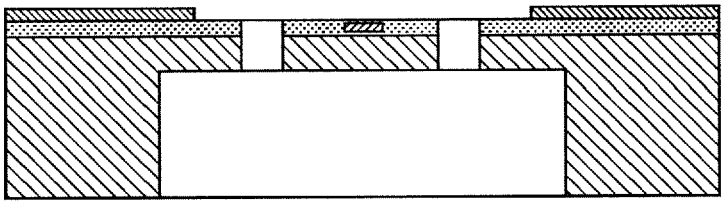

Next, the etching stop layer 44 is stripped, and the protective film 43 and the etching masks 42 and 45 are stripped. The method of stripping the etching stop layer 44 may be, for example, a method of stripping by UV (ultra violet) irradiation or a method of stripping with application of heat. The method of stripping the protective film may use, for example, typical removal liquid (HFE: hydrofluoroether) . The method of stripping the etching masks 42 and 45 uses typical resist stripping liquid. FIG. 2E illustrates a state after application of the stripping process.

Figure 2F:
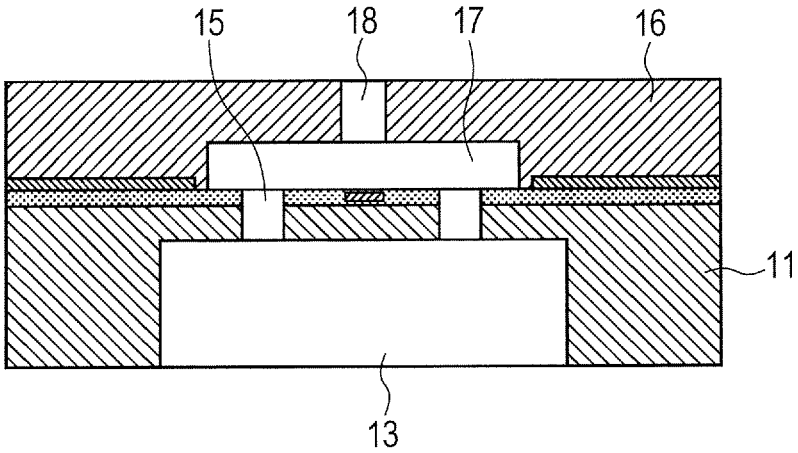

Subsequently, the orifice plate 16 where the liquid flow path 17 and the ejection orifice 18 are formed is provided on the substrate 11, thus forming the substrate for a liquid ejection head. FIG. 2F illustrates a state of the substrate 11 provided with the orifice plate 16.

A method of using a support member and photosensitive resin can be considered as the method of providing the orifice plate 16 for the substrate 11 where the first trench 13 communicates with the second trenches and the through-hole is formed. The photosensitive resin is applied onto the support member, and subsequently, the photosensitive resin is provided such that the support member is disposed across the through-substrate. The support member may be, for example, film, glass, or a silicon wafer. The support member is required to be stripped. Consequently, an appropriate support member is film. For example, the support member is polyethylene terephthalate (PET) film, polyimide film, or polyamide film. To facilitate stripping, film subjected to a mold-release treatment may be used.

As the photosensitive resin, a first photosensitive resin for forming the liquid flow path 17, and a second photosensitive resin for forming the orifice plate 16 are used. The orifice plate 16 can be formed by patterning the first photosensitive resin on the support member, film-forming the second photosensitive resin on the first photosensitive resin, providing the second photosensitive resin with a through-hole that is to serve as the ejection orifice, and subsequently removing the first photosensitive resin. The first photosensitive resin may be epoxy resin that is dissolved in organic solvent. Thus, the first photosensitive resin can be removed using the organic solvent. The first photosensitive resin may be acrylic resin or urethane resin. The method of patterning the first photosensitive resin may be a transfer method, such as a spin-coat method, slit-coat method, laminate method, or pressing method. An appropriate thickness of the first photosensitive resin ranges from 5 to 30 μm.

Subsequently, the method of forming the first trench 13 having the side surfaces on which the protective film 43 is formed is described in detail. The first trench 13 is formed using dry etching. The first trench 13 may be formed by a Bosch process that repeats etching and forming the protective film 43. Alternatively, the first trench may be formed by a non-Bosch process that forms protective film 43 at the same time of etching.

FIGS. 3A to 3E are diagrams for illustrating the process of forming the first trench 13 according to a Bosch process. In the case of using the Bosch process, $SF_6$ gas can be used as etching gas, and $C_4F_8$ gas can be used for film forming, for example. The trench may be appropriately formed by dry etching using an ICP (inductively coupled plasma) apparatus. Alternatively, another dry etching apparatus that includes another plasma source may be used. For example, another dry etching apparatus may be an ECR (electron cyclotron resonance) apparatus, or an NLD (neutral loop discharge) plasma apparatus.

The process of forming the first trench 13 includes: trench formation that etches the substrate 11 to form a trench; and depth adjustment that adjusts the depth of the trench while forming a protective film on the trench formed by the trench formation, and forms the trench as the first trench 13 having a desired depth.

Figure 3A:
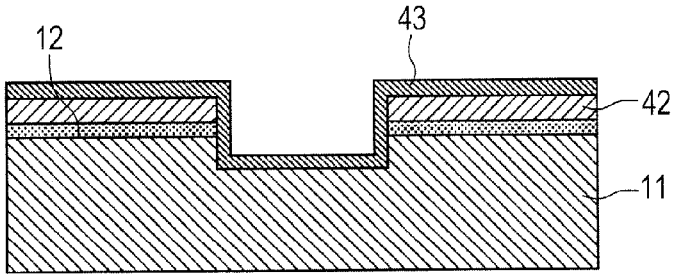
FIGS. 3A, 3B, 3C, 3D and 3E are diagrams illustrating each step of a Bosch process.

FIG. 3A illustrates a state where the protective film 43 is formed after the trench formation forms the trench. The deeper the trench becomes, the more the side surfaces of the trench are etched, thereby distorting the shape of the trench. The depth of the trench is thus required to be appropriately adjusted while the trench is protected by the protective film 43.

Figure 3B:
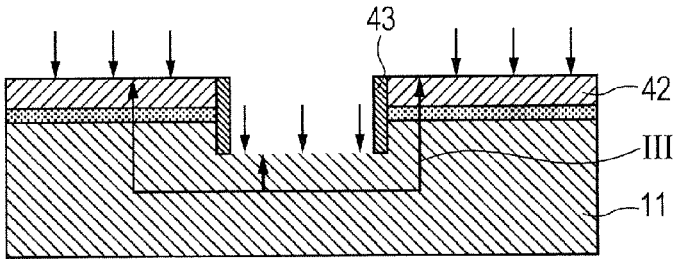

The depth adjustment that adjusts the depth of the trench sequentially repeats forming the protective film 43 on the first surface 12, etching the protective film 43 formed in a direction intersecting with the etching direction, and etching the substrate at the bottom of the trench. The repetition can protect the side surfaces of the trench with the protective film 43 to maintain the shape of the trench, and adjust the depth of the trench. FIG. 3B illustrates a state where the protective film 43 is etched in the depth adjustment. A plane III illustrated in FIG. 3B is a plane in the direction intersecting with the etching direction.

Figure 3C:
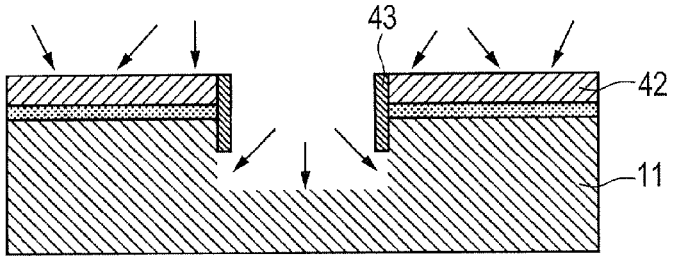
Figure 3D:
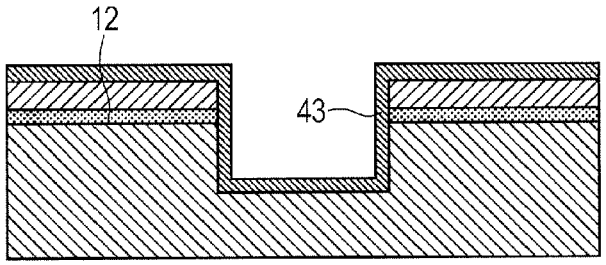
Figure 3E:
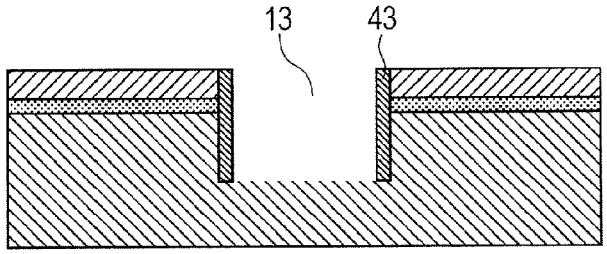

FIG. 3C illustrates a state after the substrate 11 is etched by the depth adjustment. After etching the protective film 43 exposes the substrate 11 to the surface, the substrate 11 is etched and the trench becomes deep. After the substrate 11 is etched, the protective film 43 is formed again to cover the side surfaces and the bottom surface of the trench with the protective film 43. FIG. 3D illustrates a state after the protective film 43 is formed. The portion of the protective film 43 that is formed in the direction intersecting with the etching direction in the protective film 43 is etched. FIG. 3E illustrates a state after the protective film 43 is etched.

The process of forming the first trench 13 may further include protective film adjustment that adjusts the state of the protective film 43 after the depth adjustment that adjusts the depth of the trench. The repetition of the processes of FIGS. 3A to 3C in the depth adjustment typically causes a portion where the protective film 43 is not formed on the side surfaces of the trench by etching the substrate, as illustrated in FIG. 3C. Thus, the protective film adjustment may further include formation of the protective film 43 on the first surface 12. The protective film adjustment may further include etching the protective film 43 formed in the direction intersecting with the etching direction. The protective film adjustment may form the protective film 43 in the last process. Alternatively, the protective film 43 may be etched in the last process. In the protective film adjustment, the state of the protective film 43 varies according to the number of repetitions of formation of the protective film 43 and etching of the protective film 43.

FIGS. 4A to 4E are flowcharts for illustrating an operation example of forming the first trench 13. First, in the example of FIG. 4A, a trench is formed by dry etching in a state where the etching mask 42 is formed (step S101). The formation of the protective film 43 on the first surface 12 where the trench is formed forms the protective film 43 on the first surface 12, the side surfaces and the bottom surface of the trench, as illustrated in FIG. 3A (step S102). Subsequently, the portion of the protective film 43 formed in the direction intersecting with the etching direction in the protective film 43 is etched (step S103).

As illustrated in FIG. 3B, the portion of the protective film 43 formed in the direction intersecting with the etching direction is etched to expose the substrate 11 to the surface, and the substrate 11 is then etched (step S104). It is verified whether the formed trench has reached the desired depth or not (step S105). If the trench has reached the desired depth, the trench is adopted as the first trench 13, and the process is finished. If the trench has not reached the desired depth yet, the processing returns to step S102. The processes of steps S102 to S104 are repeated until the trench reaches the desired depth.

Figure 4A:
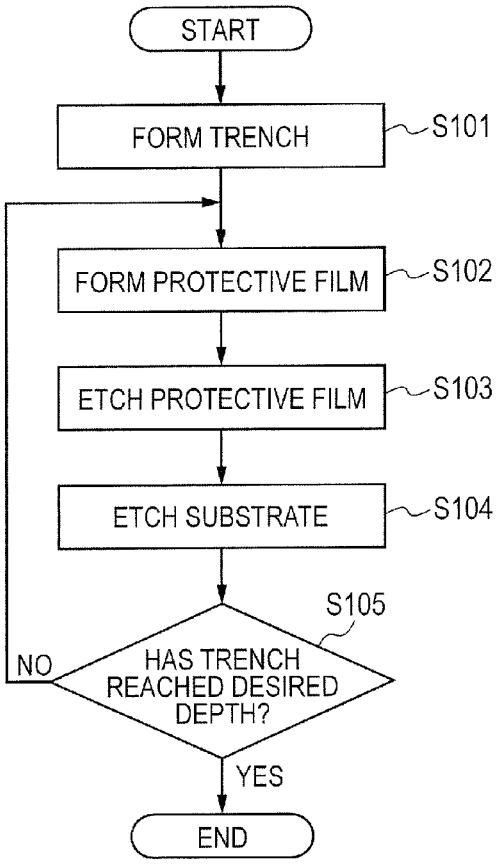
FIGS. 4A, 4B, 4C, 4D and 4E are flowcharts for illustrating the Bosch process.

In the example of FIG. 4A, etching of the substrate 11 is the last step. There is thus a possibility of causing a portion where the protective film 43 is not formed on the side surfaces of the trench, as illustrated in FIG. 3C. Consequently, the process of forming the first trench 13 may further include the protective film adjustment.

FIGS. 4B, 4C, 4D and 4E illustrate operation examples in the case of including protective film adjustment. In FIGS. 4B, 4C, 4D and 4E, the operations to step S105 are analogous to the operations in FIG. 4A. The description is thus omitted. The protective film adjustment, which is different from the case of FIG. 4A, is mainly described.

Figure 4B:
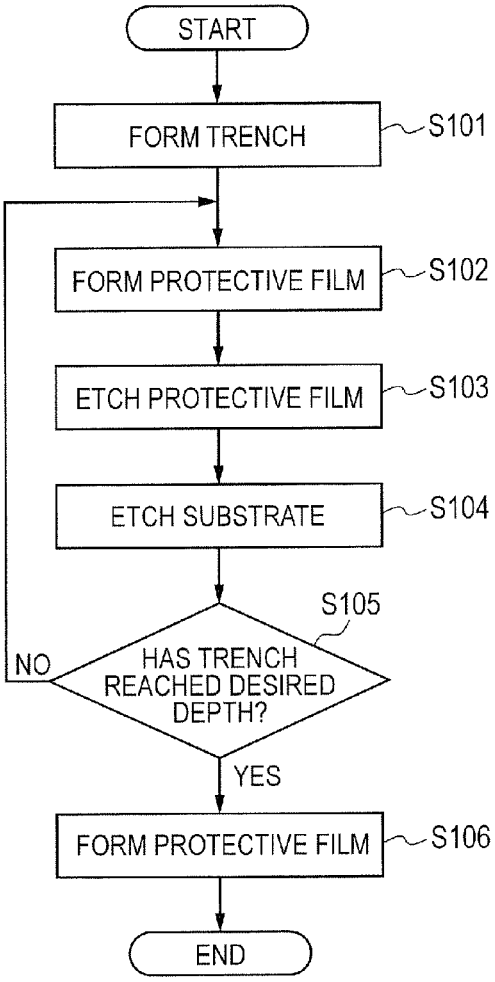

In the example of FIG. 4B, the protective film adjustment is a step of forming the protective film 43. More specifically, if it is determined in step S105 that the trench has reached the desired depth, the protective film 43 is then formed on the first surface 12 (step S106). Thus, the protective film 43 is formed at the end of the process of forming the first trench 13. Consequently, the state is brought into a state where the protective film 43 is formed on the side surfaces and the bottom surface of the first trench 13. Accordingly, even if ions and radicals reach the first trench 13 after the second trenches 15 communicate with the first trench 13 in the process of forming the second trench 15 after the process of forming the first trench 13, the side surfaces and the bottom surface of the first trench 13 can be prevented from being etched. The first trench 13 can, therefore, be maintained in the desired shape. An appropriate thickness of the protective film 43 ranges from 0.05 to 5 μm.

In the case where the process of forming the second trench 15 adopts dry etching using radicals, formation of the protective film 43 on the bottom surface of the first trench 13 allows the protective film 43 to function as an etching stop layer. The protective film 43 thus functions as the etching stop layer, which can prevent radicals from entering the first trench 13. In this case, the shape of the first trench 13 can be more securely maintained. The protective film 43 formed on the bottom surface of the first trench 13 remains after the process of forming the second trenches 15. Consequently, in the process of removing the protective film 43 formed on the side surfaces of the first trench 13, the protective film 43 on the bottom surface can also be removed at the same time of removal of the protective film 43 on the side surfaces.

In the case where the process of forming the second trenches 15 adopts dry etching using ions, even if the protective film 43 is formed on the bottom surface of the first trench 13, the protective film 43 does not function as the etching stop layer. If the protective film does not function as the etching stop layer, etching using ions etches the protective film 43 on the bottom surface. Consequently, the protective film 43 on the bottom surface can be easily removed. If the protective film 43 formed on the bottom surface of the first trench 13 is sufficiently thick (e.g., 5 μm), the protective film 43 on the bottom surface sometimes functions as the etching stop layer even by using dry etching using ions. Thus, this case can prevent ions from entering the first trench 13. The shape of the first trench 13 can be more securely maintained.

Figure 4C:
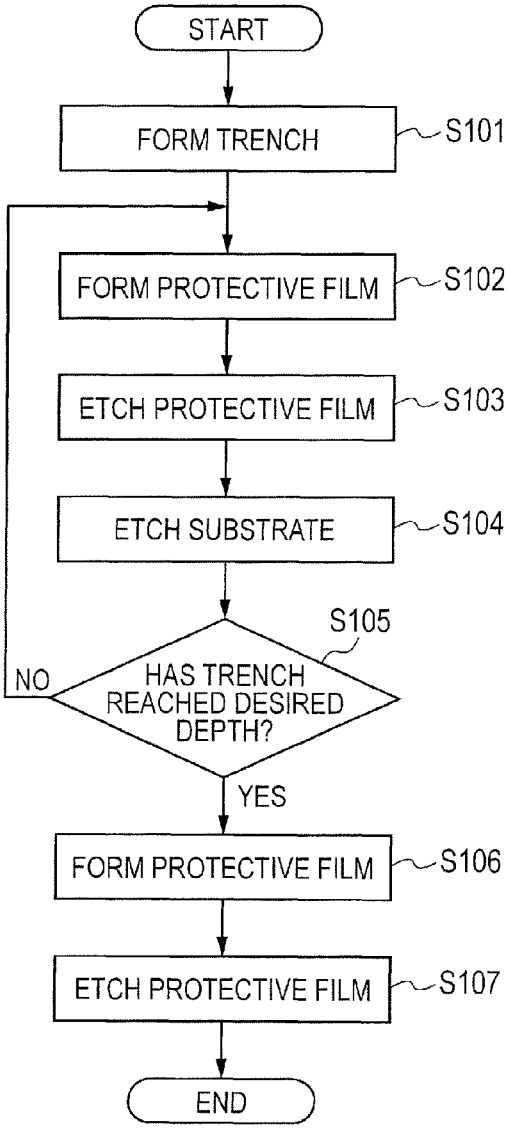

In the example of FIG. 4C, the protective film adjustment is a step of forming the protective film 43 and etching the protective film 43. More specifically, if it is determined in step S105 that the trench has reached the desired depth, the protective film 43 is formed on the first surface 12 as illustrated in FIG. 3D (step S106). The protective film formed in the direction intersecting with the etching direction of dry etching is then etched (step S107). Thus, at the end of the process of forming the first trench 13, the protective film 43 is etched. In this case, the protective film 43 is formed after the substrate 11 is etched, and the portion of the protective film 43 formed in the direction intersecting with the etching direction is etched. Consequently, as illustrated in FIG. 3E, the state is brought into a state where the protective film 43 is formed on the side surfaces of the first trench 13. Thus, the state can be prevented from being brought into a state of forming a portion where the protective film 43 is not formed on the side surfaces of the first trench 13. This example can more securely prevent the side surfaces of the first trench 13 from being etched than the example of FIG. 4A.

Figure 4D:
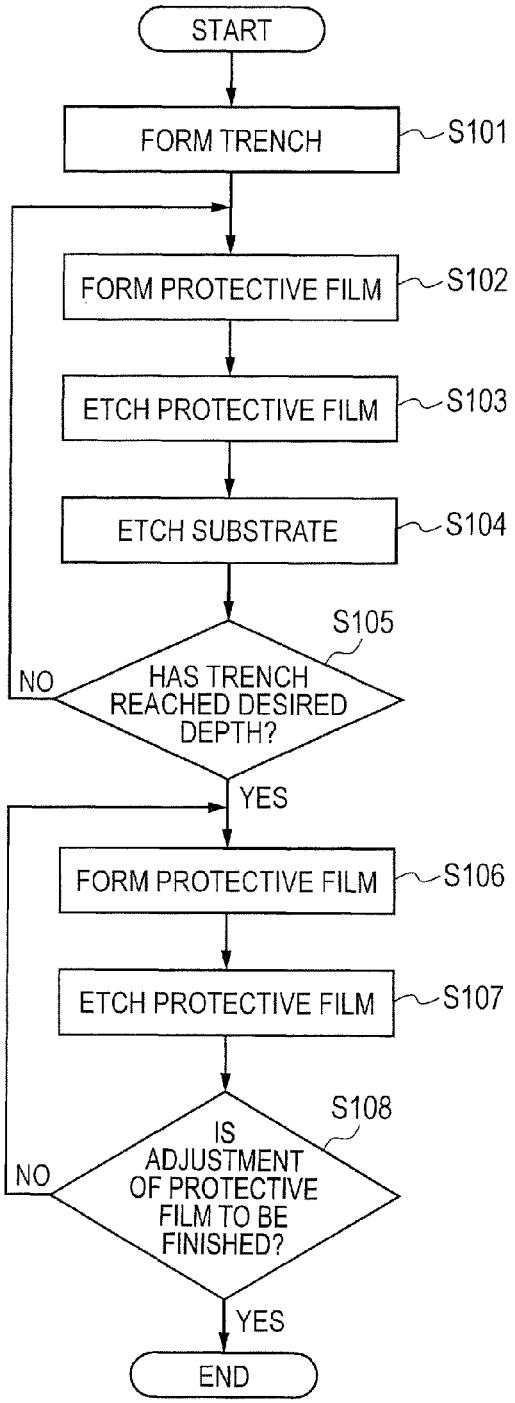

In the example of FIG. 4D, the protective film adjustment alternately repeats forming the protective film 43 and etching the protective film 43. The repetition can adjust the thickness of the protective film 43. More specifically, if the trench has reached the desired depth in step S105, the protective film 43 is formed on the first surface 12 (step S106). The protective film formed in the direction intersecting with the etching direction of dry etching is then etched (step S107). Subsequently, it is verified whether adjustment of the state of the protective film 43 is to be finished or not (step S108). If the adjustment of the state of the protective film is not to be finished, the processing returns to step S106. Accordingly, the processes of steps S106 and S107 are repeated until it is determined in step S108 that the adjustment of the state of the protective film 43 is to be finished. Thus, the state illustrated in FIG. 3D and the state illustrated in FIG. 3E are repeated. The repetition of the forming and etching of the protective film 43 can make the protective film 43 formed on the side surfaces of the first trench 13 more thick. The thick protective film 43 on the side surfaces of the first trench 13 can increase the flexibility of the etching condition for the process of forming the second trench 15. Even if an etching condition allowing relatively high-speed etching is used to form the second trenches 15 and more ions and radicals reach the first trench 13, the side surfaces of the first trench 13 can be protected.

Figure 4E:
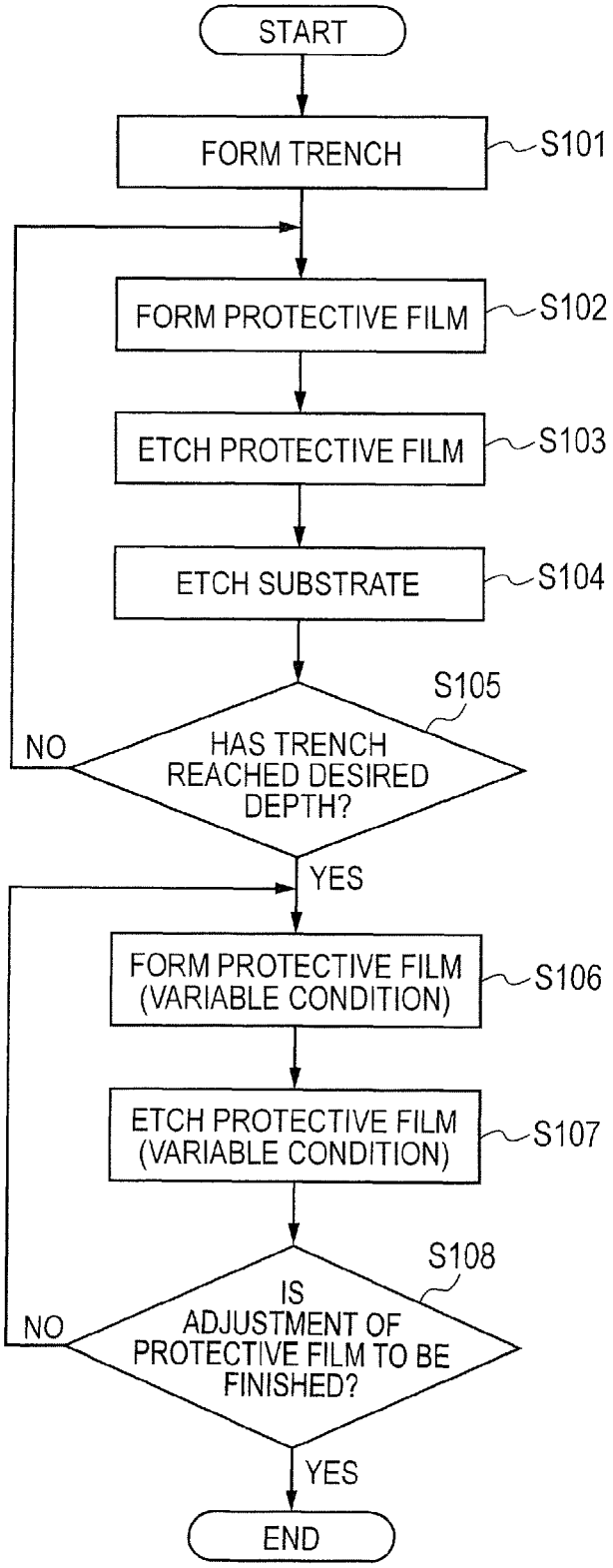

In the example of FIG. 4E, the protective film adjustment alternately repeats forming the protective film 43 and etching the protective film 43. More specifically, if it is verified in step S105 that the trench has reached the desired depth, the protective film 43 is formed on the first surface 12 (step S106). The protective film formed in the direction intersecting with the etching direction of dry etching is then etched (step S107). Subsequently, it is verified whether adjustment of the state of the protective film 43 is to be finished or not (step S108). If the adjustment of the state of the protective film is not to be finished, the processing returns to step S106. Thus, the processes of steps S106 and S107 are repeated until it is determined in step S108 that the adjustment of the state of the protective film 43 is to be finished. Consequently, the state illustrated in FIG. 3D and the state illustrated in FIG. 3E are repeated.

At this time, the condition of forming the protective film 43 in the protective film adjustment is different from the condition of forming the protective film 43 in the depth adjustment that adjusts the depth of the first trench 13. The condition of etching the protective film 43 in the protective film adjustment is different from the condition of etching the protective film 43 in the depth adjustment.

More specifically, to form the thick protective film 43 in a shorter time, the film-forming condition can be changed such that the protective film adjustment can cause the thickness of the protective film 43 formed by one time of film forming to be more thicker than the thickness of the protective film 43 formed by the depth adjustment. For example, to increase the thickness of the protective film 43 formed by one time of film forming, a method can be adopted that has a higher gas flow rate in the protective film adjustment than the gas flow rate in the depth adjustment. An appropriate gas flow rate ranges from 100 to 1000 sccm. There is another method that changes the chamber pressure or the coil power. In this case, an appropriate chamber pressure ranges from 5 to 30 Pa, and an appropriate coil power ranges from 1000 to 4500 W. In the examples of FIGS. 4D and 4E, the protective film adjustment may form the protective film 43 in the last process or etch the protective film 43 in the last process.

Subsequently, an example of forming the first trench 13 using a non-Bosch process is described. In the case of using the non-Bosch process, $SF_6$ gas and $O_2$ gas may be used. An appropriate gas pressure ranges from 0.1 to 50 Pa. An appropriate gas flow rate ranges 50 to 100 sccm. The non-Bosch process performs etching while adhering by-products generated during etching onto the side surfaces. This process is thus different from the Bosch process that alternately repeats etching and film forming, and negates the need to provide the film forming process and the etching process in a separated manner.

Here, the largeness relationship between the first trench 13 and the second trench 15, and the advantageous effects of the case of application of the technique of the present invention are described. The technique of the present invention is applicable to all of the case where the first trench 13 and the second trench 15 have the same size, the case where the second trench 15 is larger than the first trench 13, and the case where the second trench 15 is smaller than the first trench 13. However, if the case where the second trench 15 is smaller than first trench 13, the technique of the present invention can be more effectively applied. The second trench 15 is formed so as to communicate with the first trench 13 after the first trench 13 is formed. In this case, as with the formation of the first trench 13, the second trench 15 can be formed using the Bosch process or the non-Bosch process while forming the protective film 43 on the side surfaces. Typically, there is a tendency that the larger the trench to be formed, the thicker the protective film 43 is formed, and, the smaller the trench to be formed, the thinner the protective film 43 is formed. This tendency is because the larger the trench to be formed, the higher the degree of etching is, and the thick protective film 43 is required accordingly. Consequently, even if the second trench 15 is formed in the state where the protective film 43 is not formed in the first trench 13, the protective film 43 formed during formation of the second trench 15 can sometimes protect the side surfaces of the first trench 13.

More specifically, if the second trench 15 is larger than the first trench 13, the area of the side surfaces of the first trench 13 is smaller than the area of the side surfaces of the second trenches 15. Consequently, even if the second trench 15 is formed in the state where the protective film 43 is not formed on the side surfaces of the first trench 13, there is a high possibility that the side surfaces of the first trench 13 are protected. On the contrary, if the second trench 15 is smaller than the first trench 13, the side surfaces of the first trench 13 have a larger area. Consequently, there is a high possibility that the protective film 43 formed during the formation of the second trenches 15 cannot sufficiently protect the side surfaces of the first trench 13. Thus, if the second trench 15 is smaller than the first trench 13, application of the technique of the present invention is more effective.

EXAMPLES

Examples of the present invention are hereinafter described.

Example 1

First, as illustrated in FIG. 2A, a substrate 11 for a liquid ejection head was prepared where an energy generating element 19 for ejecting liquid and wiring (not illustrated) for driving the element were formed on one surface of a silicon single crystal substrate having an ingot drawing direction of <100>. A close contact enhancement layer 41 (HIMAL (trade name) manufactured by Hitachi Chemical Company, Ltd.) was pattern-formed on the surface of the substrate 11 by a photolithographic process.

Next, as illustrated in FIG. 2B, an etching mask 42 was patterned, and a first trench 13 was formed by dry etching. The etching mask was made of novolac positive resist, and film-formed to have a thickness of 10 μm, and patterned by photolithography.

The first trench 13 was etched by the non-Bosch process that performs etching using $SF_6$ gas and $O_2$ gas while by-products during etching were caused to adhere onto the side surfaces. The gas pressure ranged from 0.1 to 50 Pa. The gas flow rate ranged from 50 to 1000 sccm. Thus, the first trench 13 was formed to have a depth of 500 μm. A protective film 43 was formed on the side surfaces of the first trench 13.

Subsequently, as illustrated in FIG. 2C, an etching stop layer 44 was formed on the etching mask 42 and over the first trench 13 using tape that is used as backgrind tape.

Next, as illustrated in FIG. 2D, an etching mask 45 was patterned on the second surface 14. Second trenches were formed to communicate with the first trench 13. The etching for the second trenches 15 was dry etching adopting ions using an ICP (inductively coupled plasma) apparatus.

Subsequently, the etching stop layer 44 was stripped. The protective film 43 and the etching masks 42 and 45 were stripped. The tape was stripped while heating to 50 degrees. The protective film 43 was removed using removal liquid (HFE). The etching masks 42 and 45 were stripped using resist stripping liquid (1112A (trade name) manufactured by Rohm and Haas Electronic Material KK). FIG. 2E illustrates a state after the etching stop layer 44, the protective film 43 and the etching masks 42 and 45 were stripped.

Subsequently, as illustrated in FIG. 2F, an orifice plate 16 provided with a liquid flow path 17 and an ejection orifice 18 was formed.

Example 2

Example 2 is an example of using the Bosch process illustrated in FIG. 4B for forming a first trench 13. FIGS. 5A to 5F are diagrams illustrating a process of manufacturing a liquid ejection head 10 in the case of forming a protective film 43 at the end of a step of forming the first trench 13.

Figure 5A:
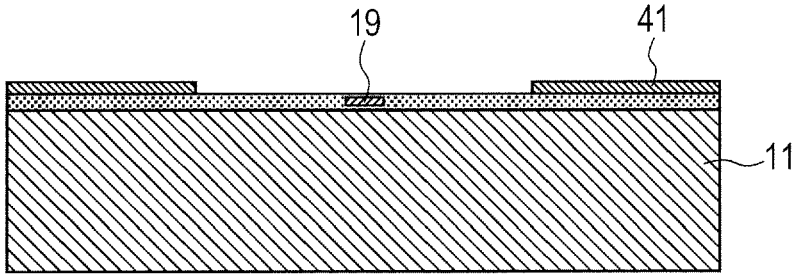
FIGS. 5A, 5B, 5C, 5D, 5E and 5F are diagrams illustrating a process of manufacturing the liquid ejection head 10 in the case of forming protective film 43 in the last process in a step of forming a first trench 13.

As illustrated in FIG. 5A, a process of preparing a substrate 11 on which an energy generating element 19 and wiring (not illustrated) for driving the element were formed, and forming a close contact enhancement layer 41 on the substrate 11 was analogous to the process in Example 1. Hereinafter, the difference from Example 1 is mainly described.

Figure 5B:
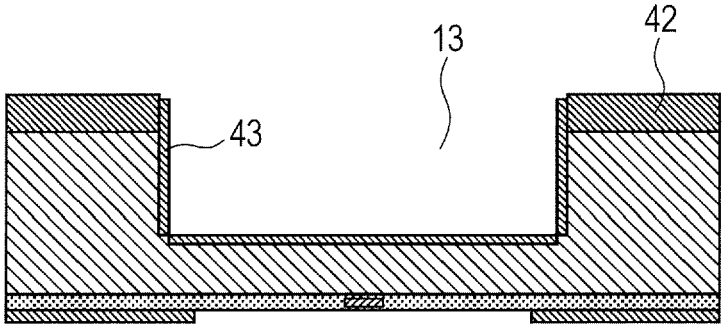
Figure 5C:
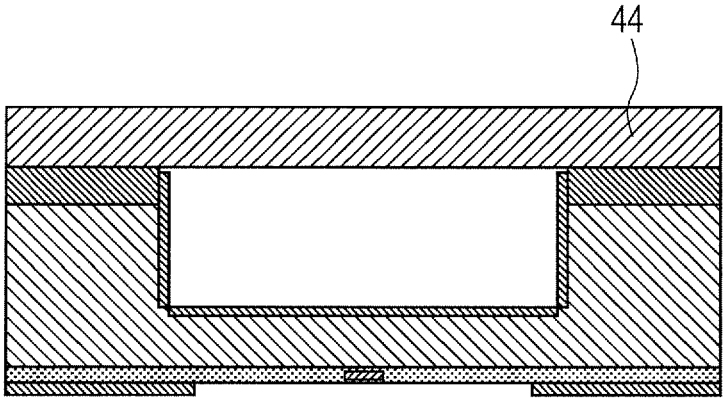
Figure 5D:
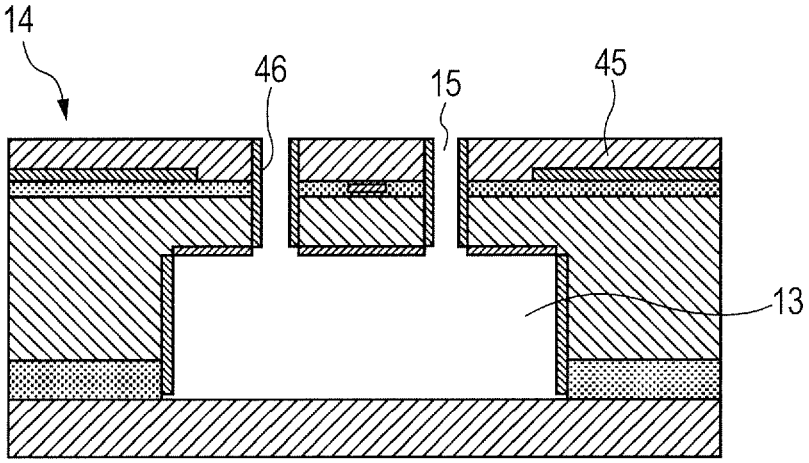
Figure 5E:
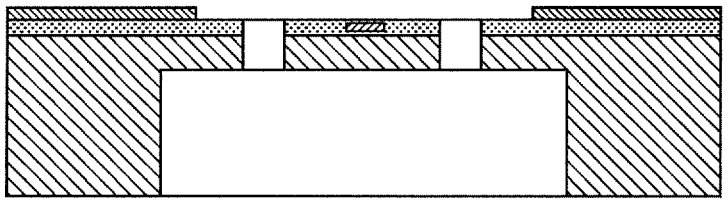
Figure 5F:
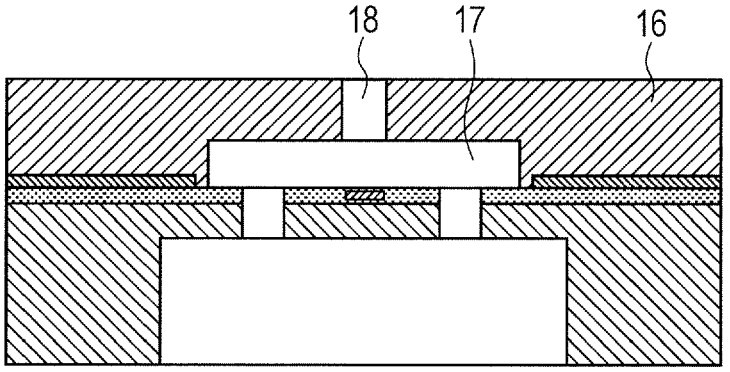

Subsequently, as illustrated in FIG. 5B, an etching mask 42 was patterned. The first trench 13 was formed by dry etching. The first trench 13 was etched using a dry etching apparatus including an ICP apparatus. As etching gas, $SF_6$ gas was used. The protective film was formed using $C_4F_8$ gas. As etching conditions, the conditions of the Bosch process illustrated in FIG. 4B were used. This process performed the step of forming the protective film 43 in the last process. Consequently, the first trench 13 was formed to have a depth of 500 μm. The protective film 43 was formed on the side surfaces and the bottom surface of the first trench 13.

Example 3

Example 3 is an example of using the Bosch process illustrated in FIG. 4C for forming a first trench 13. Example 3 is analogous to Example 1 except for the process of forming the first trench 13. Accordingly, the difference from Example 1 is mainly described below.

As illustrated in FIG. 2B, an etching mask 42 was patterned, and the first trench 13 was formed by dry etching. An etching mask 42 was formed with novolac positive resist to have a thickness of 10 μm, and patterned using photolithography.

The first trench 13 was etched by a dry etching apparatus including an ICP apparatus. The etching gas was $SF_6$ gas. A protective film was formed using $C_4F_8$ gas. As etching conditions, the conditions of the Bosch process illustrated in FIG. 4C was used. In this process, the step of etching the portion of the protective film 43 formed in the direction intersecting with the etching direction was performed in the last process. Consequently, the protective film 43 was formed on the side surfaces of the first trench 13.

Example 4

Example 4 is an example of using the Bosch process illustrated in FIG. 4D for forming a first trench 13. Example 4 is analogous to Example 1 except for the process of forming the first trench 13. Accordingly, the difference from Example 1 is mainly described below.

The first trench 13 was etched by a dry etching apparatus including an ICP apparatus. The etching gas was $SF_6$ gas. A protective film was formed using $C_4F_8$ gas. As etching conditions, the conditions of the Bosch process illustrated in FIG. 4D was used. This process adjusted the depth of the first trench 13, and subsequently repeated forming and etching a protective film 43 twenty times. Consequently, on the side surfaces of the first trench 13, the protective film 43 thicker than the film of each of Examples 2 and 3 was formed (not illustrated).

Example 5

Example 5 is an example of using the Bosch process illustrated in FIG. 4E for forming a first trench 13, with the gas flow rate being changed among the film-forming conditions. Example 5 is analogous to Example 1 except for the process of forming the first trench 13. Accordingly, the difference from Example 1 is mainly described below.

The first trench 13 was etched by a dry etching apparatus including an ICP apparatus. The etching gas was $SF_6$ gas. A protective film 43 was formed using $C_4F_8$ gas. As etching conditions, the conditions of the Bosch process illustrated in FIG. 4E was used. According to this process, in the process of adjusting the depth of the first trench (steps S102 to S104), the flow rate of $C_4F_8$ gas ranged from 50 to 800 sccm. The thickness of the protective film 43 formed by one time of film formation was about 0.01 μm.

Subsequently, the process (steps S106 to S107) of adjusting the state of the protective film 43 was repeated fifteen times. Here, the gas flow rate was changed to range from 100 to 1000 sccm. This change allowed the thickness of the protective film 43 formed by one time of film formation to be about 0.03 μm. Consequently, on the side surfaces of the first trench 13, the thicker protective film 43 than the film of each of Examples 2 and 3 was formed in a shorter time than the time in Example 4 (not illustrated).

Example 6

Example 6 is an example of using the Bosch process illustrated in FIG. 4E for forming a first trench 13, with the chamber pressure being changed among the film-forming conditions. Example 6 is analogous to Example 1 except for the process of forming the first trench 13. Accordingly, the difference from Example 1 is mainly described below.

The first trench 13 was etched by a dry etching apparatus including an ICP apparatus. The etching gas was $SF_6$ gas. A protective film 43 was formed using $C_4F_8$ gas. As etching conditions, the conditions used in the Bosch process illustrated in FIG. 4E was used. According to this process, in the process of adjusting the depth of the first trench 13 (steps S102 to S104), the chamber pressure ranged from 2 to 20 Pa. The thickness of the protective film 43 formed by one time of film formation was about 0.01 μm.

Subsequently, the process (steps S106 to S107) of adjusting the state of the protective film 43 was repeated fifteen times. Here, the chamber pressure was changed to range from 5 to 30 Pa. This change allowed the thickness of the protective film 43 formed by one time of film formation to be about 0.02 μm. Consequently, on the side surfaces of the first trench 13, the thicker protective film 43 than the film of each of Examples 2 and 3 was formed in a shorter time than the time in Example 4 (not illustrated).

Example 7

Example 7 is an example of using the Bosch process illustrated in FIG. 4E for forming a first trench 13, with the coil power being changed among the film-forming conditions. Example 7 is analogous to Example 1 except for a process of forming a first trench 13. Accordingly, the difference from Example 1 is mainly described below.

The first trench 13 was etched by a dry etching apparatus including an ICP apparatus. The etching gas was $SF_6$ gas. A protective film 43 was formed using $C_4F_8$ gas. As etching conditions, the conditions used in the Bosch process illustrated in FIG. 4E was used. According to this process, in the process of adjusting the depth of the first trench 13 (steps S102 to S104), the coil power ranged from 1000 to 4000 W. The thickness of the protective film 43 formed by one time of film formation was about 0.01 μm.

Subsequently, the process (steps S106 to S107) of adjusting the state of the protective film 43 was repeated fifteen times. Here, the coil power was changed to range from 1200 to 4500 W. This change allowed the thickness of the protective film 43 formed by one time of film formation to be about 0.02 μm. Consequently, on the side surfaces of the first trench 13, the thicker protective film 43 than the film of each of Examples 2 and 3 was formed in a shorter time than the time in Example 4 (not illustrated).

The invention of this application has been described with reference to the embodiments. However, the invention of this application is not limited to the embodiments. Alternatively, various changes that those skilled in the art can understand may be made to the configuration and details of the invention of this application within the scope of the invention of this application.

For example, in the embodiments, the through-substrate is used for the liquid ejection head 10. However, the present invention is not limited to such an example. For instance, instead of the case for the liquid ejection head, the technique of the present invention is applicable widely to cases of forming a through-hole in a substrate.

In the embodiments, the second trench 15 is smaller trenches than the first trench 13. However, the present invention is not limited to such an example. For instance, the technique of the present invention is also applicable to the case where the second trench has the same size as the first trench has, and the case where the second trench is larger than the first trench.

In the embodiments, the multiple second trenches communicating with the single first trench are formed. However, the present invention is not limited to such an example. The present invention is widely applicable to the cases of forming trenches on the first surface and the second surface to form a through-hole.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-123349, filed Jun. 16, 2014, which is hereby incorporated by reference herein in its entirety.

What is claimed is:

1. A method of forming a through-substrate having a first surface and a second surface opposite to the first surface, the method causing the first surface to communicate with the second surface through the substrate, the method comprising:

a first step that forms a first trench having a protective film on its side surfaces using dry etching from a side of the first surface of the substrate, the dry etching comprising a process that performs etching and forming the protective film; and a second step that forms a second trench from a side of the second surface of the substrate using dry etching, the second trench communicating with the first trench, wherein the dry etching in the second step is performed while the protective film formed in the first step is present on the side surfaces of the first trench, wherein the first step comprises:

a trench formation that etches the substrate, and forms a trench;

a depth adjustment that adjusts a depth of the trench while forming the protective film on the side surfaces of the trench by the dry etching, and forms the trench as the first trench; and a protective film adjustment that adjusts a state of the protective film after the depth adjustment, and wherein the protective film adjustment comprises forming the protective film on the first surface.

2. The method of forming the through-substrate according to claim 1, wherein the depth adjustment sequentially repeats forming the protective film on the first surface, etching the protective film formed in a direction intersecting with an etching direction of the dry etching, and etching the substrate.

3. The method of forming the through-substrate according to claim 1, wherein the protective film adjustment further comprises etching the protective film formed in a direction intersecting with an etching direction of the dry etching.

4. The method of forming the through-substrate according to claim 3, wherein the protective film adjustment alternately repeats forming the protective film, and etching the protective film.

5. The method of forming the through-substrate according to claim 4, wherein the protective film adjustment performs a formation of the protective film in a last process.

6. The method of forming the through-substrate according to claim 4, wherein the protective film adjustment performs an etching of the protective film in a last process.

7. The method of forming the through-substrate according to claim 1, wherein a thickness of the protective film formed by the protective film adjustment is larger than a thickness of the protective film formed by the depth adjustment.

8. The method of forming the through-substrate according to claim 1, wherein the substrate is a substrate for a liquid ejection head.

9. The method of forming the through-substrate according to claim 1, wherein the protective film is grown in an etching direction during the dry etching, the dry etching comprising a process that sequentially repeats forming the protective film on the first surface, etching the protective film formed in a direction intersecting with the etching direction, and etching the substrate.

10. The method of forming the through-substrate according to claim 1, wherein the first trench is etched while adhering by-products generated during the dry etching onto the side surfaces to form the protective film.

11. The method of forming the through-substrate according to claim 1, wherein the protective film adjustment comprises forming the protective film on the first surface using $C_4F_8$ gas.

12. The method of forming the through-substrate according to claim 1, wherein the protective film adjustment comprises forming the protective film on the first surface using a dry etching apparatus.

13. The method of forming the through-substrate according to claim 1, wherein the second step comprises etching the substrate to form the second trench in the substrate.

14. The method of forming the through-substrate according to claim 1, wherein the substrate is a silicon single crystal substrate.

* * * * *